US011578592B2

(12) United States Patent
Chang et al.

(10) Patent No.: US 11,578,592 B2
(45) Date of Patent: Feb. 14, 2023

(54) ROBUST LOGGING-WHILE-DRILLING SONIC TRANSMITTERS WITH IMPROVED STRENGTH AND BANDWIDTH

(71) Applicant: Halliburton Energy Services, Inc., Houston, TX (US)

(72) Inventors: Chung Chang, Houston, TX (US); Michael Shaun Spencer, Spring, TX (US); Peng Li, Houston, TX (US); Jing Jin, Singapore (SG); Jose Sanchez, Houston, TX (US); Haoshi Song, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 153 days.

(21) Appl. No.: 17/104,751

(22) Filed: Nov. 25, 2020

(65) Prior Publication Data

US 2022/0162938 A1 May 26, 2022

(51) Int. Cl.
*E21B 47/18* (2012.01)
*E21B 47/14* (2006.01)
(Continued)

(52) U.S. Cl.
CPC ..... *E21B 47/16* (2013.01); *E21B 17/16* (2013.01)

(58) Field of Classification Search
None
See application file for complete search history.

(56) References Cited

U.S. PATENT DOCUMENTS 6,084,826 A 7/2000 Leggett, III
6,631,327 B2 * 10/2003 Hsu ..... G01V 1/284 702/6

(Continued)

FOREIGN PATENT DOCUMENTS

CN 107109926 A * 8/2017 ..... E21B 17/003
WO 2020/036579 A1 2/2020

OTHER PUBLICATIONS

International Search Report and Written Opinion issued in related PCT Application No. PCT/US2020/064274 dated Jul. 29, 2021, 11 pages.

*Primary Examiner* — Curtis A Kuntz
*Assistant Examiner* — Jerold B Murphy
(74) *Attorney, Agent, or Firm* — Kilpatrick Townsend & Stockton LLP

(57) ABSTRACT

The disclosure provides an acoustic logging device comprising a first tubular member comprising a plurality of grooves disposed on an exterior of the first tubular member. The acoustic logging device further comprises a ring transmitter module disposed around an exterior of the first tubular member, which comprises a piezoelectric (PZT) ring transmitter, a transmitter sleeve, wherein the PZT ring transmitter is disposed within the transmitter sleeve, and a cage, wherein the transmitter sleeve is disposed between the cage and the exterior of the first tubular member, wherein the transmitter sleeve is disposed over the plurality of grooves. The acoustic logging device further comprises a plurality of dual bender transmitters, wherein there is a gap disposed the plurality of dual bender transmitters in the exterior of the first tubular member, wherein there is an array of holes connecting each of the gaps together and providing fluid communication between the gaps.

19 Claims, 6 Drawing Sheets

(51) Int. Cl.

| | |
|---|---|
| ***E21B 47/107*** | (2012.01) |
| ***E21B 47/16*** | (2006.01) |
| ***E21B 17/16*** | (2006.01) |

(56) References Cited

U.S. PATENT DOCUMENTS

| | | | | |
|---|---|---|---|---|
| 6,909,666 | B2 * | 6/2005 | Dubinsky | G10K 9/121 702/6 |
| 9,476,293 | B2 | 10/2016 | Nakajima et al. | |
| 9,823,375 | B2 | 11/2017 | Nakajima et al. | |
| 10,393,903 | B2 | 8/2019 | Jin et al. | |
| 2005/0000688 | A1 | 1/2005 | Hsu et al. | |
| 2009/0129203 | A1 | 5/2009 | Jones et al. | |
| 2011/0198093 | A1 | 8/2011 | Shaikh | |
| 2017/0285205 | A1 * | 10/2017 | Jin | G01V 1/52 |
| 2018/0100387 | A1 * | 4/2018 | Kouchmeshky | G01N 29/2412 |
| 2019/0257970 | A1 | 8/2019 | Fang | |

* cited by examiner

ROBUST LOGGING-WHILE-DRILLING SONIC TRANSMITTERS WITH IMPROVED STRENGTH AND BANDWIDTH

TECHNICAL FIELD OF THE INVENTION

The present disclosure relates generally to logging operations and, more particularly, to systems and methods for improved acoustic logging devices.

BACKGROUND

Acoustic logging operations are used to collect data regarding the formations around a wellbore. Typically, an acoustic logging tool in the form of a wireline tool or logging while drilling tool is positioned within the wellbore to collect this data. The acoustic logging tool emits one or more acoustic signals in multiple directions at the surrounding wellbore wall or formation. The acoustic signal travels through the formation and returns to the logging tool having been altered by the formation. As different characteristics of the formation alter the signal differently, the returning signal carries data regarding the characteristics of the formation. Thus, by processing and analyzing the returning signal, the formation characteristics can be obtained.

Acoustic logging tools generally utilize an acoustic source such as an acoustic transducer, which produces an acoustic output. Depending on the parameters of the logging operation, it may be desired for the acoustic output to have a strong output at certain frequencies or over a certain frequency range.

Figure 1:
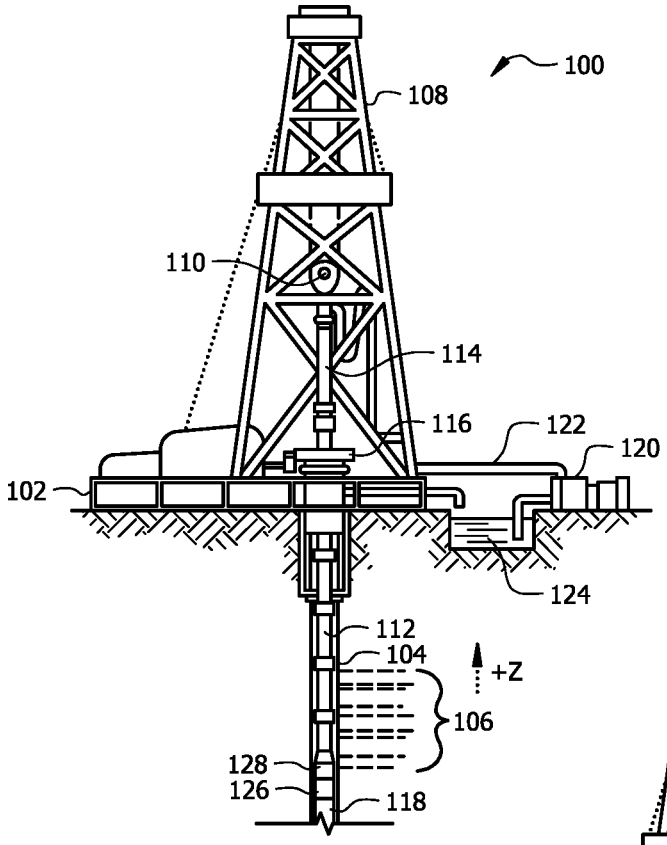
FIG. 1 is a schematic diagram of a drilling system at a well site, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "l" and any one of which may be referred to generically as a widget "l". In the figures and the description, like numerals are intended to represent like elements.

To facilitate a better understanding of the present disclosure, the following examples of certain embodiments are given. In no way should the following examples be read to limit, or define, the scope of the disclosure. Embodiments described below with respect to one implementation are not intended to be limiting.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EE- PROM), and/or flash memory; as well as communications media such wires, optical fibers, microwaves, radio waves, and other electromagnetic and/or optical carriers; and/or any combination of the foregoing.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

Downhole environments may have harsh operating conditions such as abrasive and erosive fluids including liquids, solid particles, and other debris. During downhole logging operations, for example, measurement while drilling (MWD) and logging while drilling (LWD) operations, a downhole tool may include sections that include sensitive electronics for receiving data related to a formation of interest or any other object. These electronics are susceptible to damage and failure due to the harsh downhole operating conditions. Thus, these electronics must be protected while at the same time provided with the ability to obtain the desired measurements or data.

The present disclosure provides for systems and methods for improved acoustic logging devices for downhole operations. The provided systems and methods may be able provide an acoustic logging device capable of utilization within a logging-while drilling setting. In one or more embodiments, the output of the transmitters may be increased to improve the signal-to-noise (S/N) ratio. In embodiments, the disclosed systems and methods accommodate the noise and vibrations of the drilling environment while maintaining acoustic strength and bandwidth.

FIG. 1 is a schematic diagram of an exemplary drilling system 100 that may employ the principles of the present disclosure, according to one or more embodiments. As illustrated, the drilling system 100 may include a drilling platform 102 positioned at the surface and a wellbore 104 that extends from the drilling platform 102 into one or more subterranean formations 106. In other embodiments, such as in an offshore drilling operation, a volume of water may separate the drilling platform 102 and the wellbore 104. Even though FIG. 1 depicts a land-based drilling platform 102, it will be appreciated that the embodiments of the present disclosure are equally well suited for use in other types of drilling platforms, such as offshore platforms, or rigs used in any other geographical locations. The present disclosure contemplates that wellbore 104 may be vertical, horizontal or at any deviation.

The drilling system 100 may include a derrick 108 supported by the drilling platform 102 and having a traveling block 110 for raising and lowering a conveyance 112, such as a drill string. A kelly 114 may support the conveyance 112 as it is lowered through a rotary table 116. A drill bit 118 may be coupled to the conveyance 112 and driven by a downhole motor and/or by rotation of the conveyance 112 by the rotary table 116. As the drill bit 118 rotates, it creates the wellbore 104, which penetrates the subterranean formations 106. A pump 120 may circulate drilling fluid through a feed pipe 122 and the kelly 114, downhole through the interior of conveyance 112, through orifices in the drill bit 118, back to the surface via the annulus defined around conveyance 112, and into a retention pit 124. The drilling fluid cools the drill bit 118 during operation and transports cuttings from the wellbore 104 into the retention pit 124.

The drilling system 100 may further include a bottom hole assembly (BHA) coupled to the conveyance 112 near the drill bit 118. The BHA may comprise various downhole measurement tools such as, but not limited to, measurement-while-drilling (MWD) and logging-while-drilling (LWD) tools, which may be configured to take downhole measurements of drilling conditions. The MWD and LWD tools may include at least one acoustic logging device 126, which may comprise one or more transmitters capable of transmitting one or more acoustic signals into the surrounding one or more subterranean formations 106. The one or more transmitters are protected by a sleeve within the conveyance 112 as discussed below with respect to FIG. 4.

As the drill bit 118 extends the wellbore 104 through the formations 106, the acoustic logging device 126 may continuously or intermittently transmit signals and receive back signals relating to a parameter of the formations 106, for example, impulse signal such as Wicker wavelet, Blackman pulse or its higher order time derivatives, as well as chirp signals, etc. The acoustic logging device 126 and other sensors of the MWD and LWD tools may be communicably coupled to a telemetry module 128 used to transfer measurements and signals from the BHA to a surface receiver (not shown) and/or to receive commands from the surface receiver. The telemetry module 128 may encompass any known means of downhole communication including, but not limited to, a mud pulse telemetry system, an acoustic telemetry system, a wired communications system, a wireless communications system, or any combination thereof. In certain embodiments, some or all of the measurements taken at the acoustic logging device 126 may also be stored within the acoustic logging device 126 or the telemetry module 128 for later retrieval at the surface upon retracting the conveyance 112.

Figure 2:
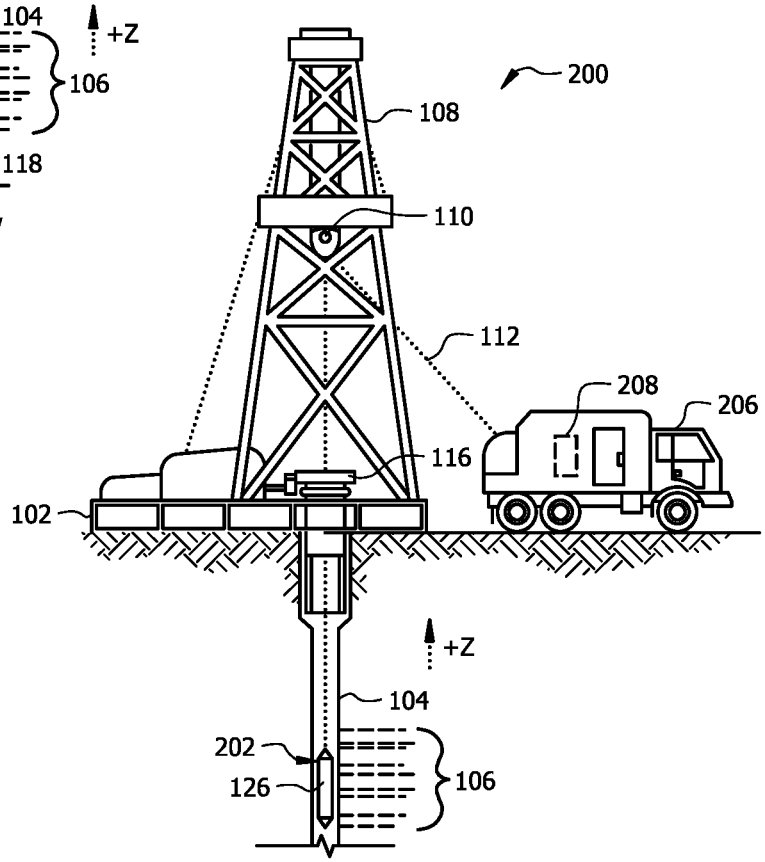
FIG. 2 is a schematic diagram of a wireline system at a well site, according to one or more aspects of the present disclosure.

At various times during the drilling process, the conveyance 112 may be removed from the wellbore 104, as shown in FIG. 2, to conduct measurement/logging operations. More particularly, FIG. 2 depicts a schematic diagram of an exemplary wireline system 200 that may employ the principles of the present disclosure, according to one or more embodiments. Like numerals used in FIGS. 1 and 2 refer to the same components or elements and, therefore, may not be described again in detail. As illustrated, the wireline system 200 may include a wireline instrument sonde 202 that may be suspended into the wellbore 104 by another conveyance 112, such as a wireline cable. The wireline instrument sonde 202 may include the acoustic logging device 126 described above, which may be communicably coupled to the conveyance 112. In some embodiments, the acoustic logging device 126 is configured to emit acoustic signals to the walls of the wellbore 104 and through the one or more subterranean formations 106 and to detect the returning acoustic data signals. The returning acoustic data signals are altered from the original acoustic signals based on the mechanical properties of the one or more subterranean formations 106, such as compressional velocity, shear velocity, and the like. Thus, the acoustic data signals carry this data and can be filtered and/or processed to obtain the formation data.

The conveyance 112 may include conductors for transporting power to the wireline instrument sonde 202 and also to facilitate communication between the surface and the wireline instrument sonde 202. A logging facility 206, shown in FIG. 2 as a truck, may collect measurements from the acoustic logging device 126, and may include an information handling system 208 for controlling, processing, storing, and/or visualizing the measurements gathered by the acoustic logging device 126. The information handling system 208 may be communicably coupled to the acoustic logging device 126 by way of the conveyance 112. In one or more embodiments, the information handling system 208 may be disposed about any suitable location in the drilling system 100 (referring to FIG. 1) and/or in the wireline system 200. In alternate embodiments, information handling system 208 may be located remotely from the system 100. The information handling system 208 may be directly or indirectly coupled to any one or more components of the drilling system 100 and/or the wireline system 200.

Figure 3:
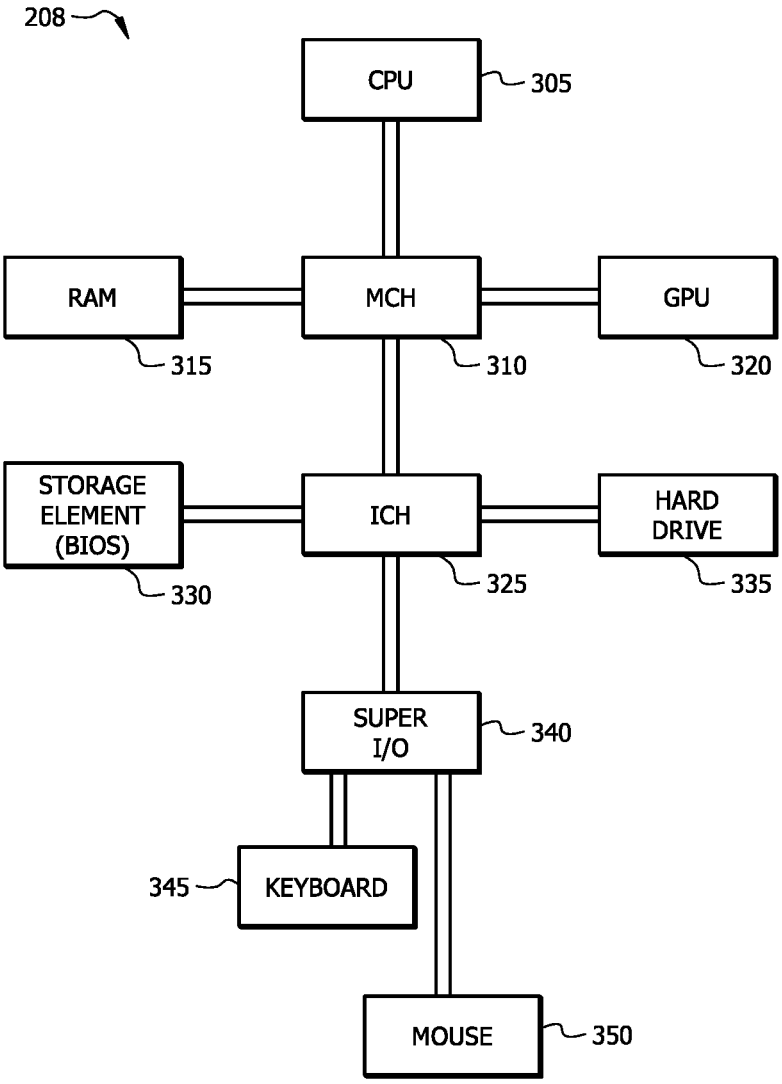
FIG. 3 is a diagram illustrating an example information handling system, according to aspects of the present disclosure.

FIG. 3 is a diagram illustrating an example information handling system 208, according to aspects of the present disclosure. A processor or central processing unit (CPU) 305 of the information handling system 208 is communicatively coupled to a memory controller hub or north bridge 310. The processor 305 may include, for example a microprocessor, microcontroller, digital signal processor (DSP), application specific integrated circuit (ASIC), or any other digital or analog circuitry configured to interpret and/or execute program instructions and/or process data. Processor 305 may be configured to interpret and/or execute program instructions or other data retrieved and stored in any memory such as memory 315 or hard drive 335. Program instructions or other data may constitute portions of a software or application for carrying out one or more methods described herein. Memory 315 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 315 for execution by processor 305.

Modifications, additions, or omissions may be made to FIG. 3 without departing from the scope of the present disclosure. For example, FIG. 3 shows a particular configuration of components of information handling system 208. However, any suitable configurations of components may be used. For example, components of information handling system 208 may be implemented either as physical or logical components. Furthermore, in some embodiments, functionality associated with components of information handling system 208 may be implemented in special purpose circuits or components. In other embodiments, functionality associated with components of information handling system 208 may be implemented in configurable general-purpose circuit or components. For example, components of information handling system 208 may be implemented by configured computer program instructions.

Memory controller hub (MCH) 310 may include a memory controller for directing information to or from various system memory components within the information handling system 208, such as memory 315, storage element 330, and hard drive 335. The memory controller hub 310 may be coupled to memory 315 and a graphics processing unit (GPU) 320. Memory controller hub 310 may also be coupled to an I/O controller hub (ICH) or south bridge 325. I/O controller hub 325 is coupled to storage elements of the information handling system 208, including a storage element 330, which may comprise a flash ROM that includes a basic input/output system (BIOS) of the computer system. I/O controller hub 325 is also coupled to the hard drive 335 of the information handling system 208. I/O controller hub 325 may also be coupled to a Super I/O chip 340, which is itself coupled to several of the I/O ports of the computer system, including keyboard 345 and mouse 350.

In certain embodiments, the information handling system 208 may comprise at least a processor and a memory device coupled to the processor that contains a set of instructions that when executed cause the processor to perform certain actions. In any embodiment, the information handling system 208 may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system 208 may include random access memory (RAM), one or more processing resources such as a central processing unit (CPU) or hardware or software control logic, read only memory (ROM), and/or other types of nonvolatile memory. Additional components of the information handling system 208 may include one or more disk drives, one or more network ports for communication with external devices as well as various input and output (I/O) devices, such as a keyboard, a mouse, and a video display. The information handling system 208 may also include one or more buses operable to transmit communications between the various hardware components.

Figure 4:
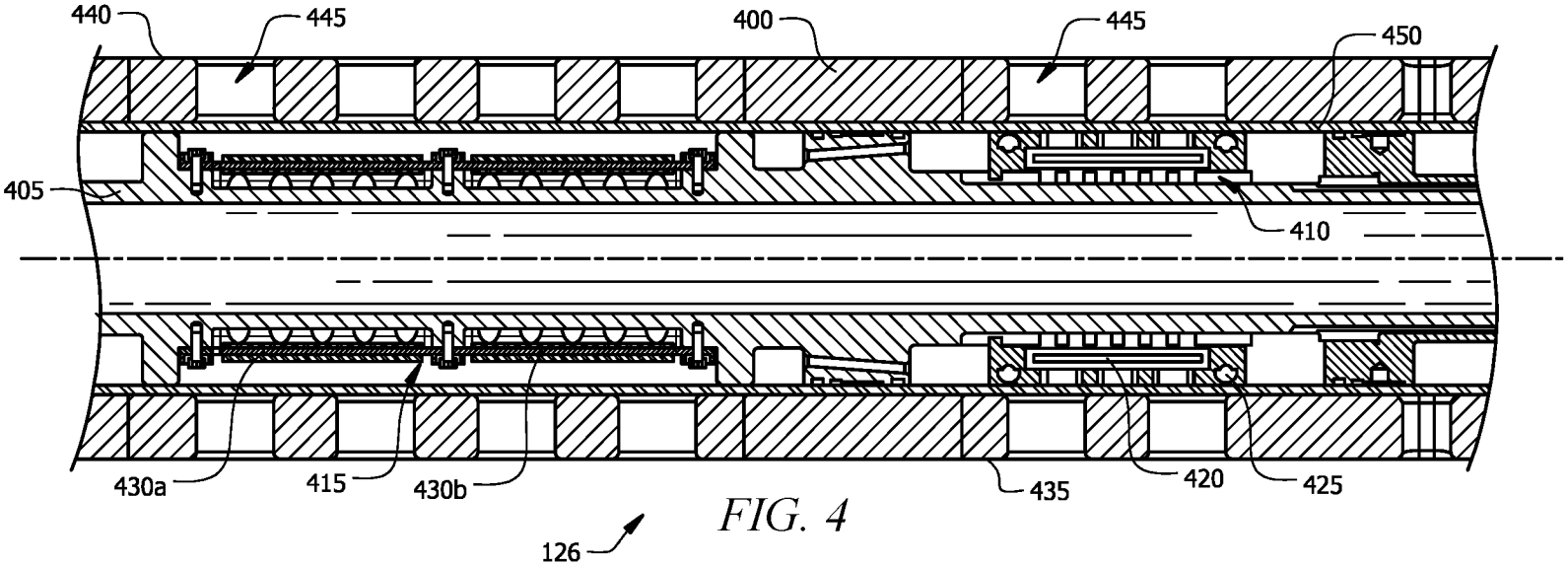
FIG. 4 is a diagram illustrating an example acoustic logging device, according to aspects of the present disclosure.

FIG. 4 illustrates an example acoustic logging device 126 incorporated into a portion of a drill collar 400. As illustrated, the acoustic logging device 126 may comprise a first tubular member 405 disposed within the drill collar 400. The first tubular member 405 may comprise any suitable size, height, shape, and any combinations thereof. Further, the first tubular member 405 may comprise any suitable materials, such as metals, nonmetals, polymers, composites, and any combinations thereof. The acoustic logging device 126 may further comprise a ring transmitter module 410 and a plurality of dual bender transmitters 415, where the first tubular member 405 may be configured to house, contain, and/or position the ring transmitter module 410 and the plurality of dual bender transmitters 415 within suitable portions of the drill collar 400. The acoustic logging device may further comprise a receiver array section (not shown) disposed at an appropriate offset distance with respect to the ring transmitter module 410 and the plurality of dual bender transmitters 415. The ring transmitter module 410 may comprise a piezoelectric (PZT) ring transmitter 420 and a cage 425 disposed around the PZT ring transmitter 420. The PZT ring transmitter 420 may be configured to generate an acoustic signal in axially symmetric modes, for example, a monopole signal, when actuated.

In embodiments, the cage 425 may be configured to contain the PZT ring transmitter 420 and to protect and/or shield the PZT ring transmitter 420 from being damaged by an external environment. As illustrated, the ring transmitter module 410 may be disposed downhole from the plurality of dual bender transmitters 415. The plurality of dual bender transmitters 415 may be configured to generate a unipole type of signal. A combination of different pairs the plurality of dual bender transmitters 415 may generate monopole, dipole or quadrupole type of signals when actuated with a predetermined polarity, for example, a pair of the plurality of dual bender transmitters 415 at 180 degree apart with opposite polarity may excite a dipole signal. In one or more embodiments, each of the plurality of dual bender transmitters 415 may comprise a first acoustic transducer 430*a* and a second acoustic transducer 430*b* that are coupled together. During operations, actuating one of the plurality of dual bender transmitters 415 may actuate both of the first acoustic transducer 430*a* and the second acoustic transducer 430*b* of that specific one of the plurality of dual bender transmitters 415.

In embodiments, the ring transmitter module 410 may align within the length of a first portion 435 of the drill collar 400. Similarly, the plurality of dual bender transmitters 415 may be aligned within the length of a second portion 440 of the drill collar 400. Both the first portion 435 and the second portion 440 of the drill collar may be any suitable size, height, shape, and combinations thereof. In certain embodiments, the first portion 435 may have a length less than the length of the second portion 440. In other embodiments, the length of the first portion 435 may be equivalent to or greater than the length of the second portion 440. As depicted, both the first portion 435 and the second portion 440 of the drill collar 400 may comprise one or more slots 445 disposed throughout each of the first portion 435 and the second portion 440. Each of the first portion 435 and the second portion 440 may comprise any suitable number of one or more slots 445. In one or more embodiments, the first portion 435 may comprise a greater number of one or more slots 445 than the second portion 440. In further embodiments, the first portion 435 may comprise a fewer number of one or more slots 445 than the second portion 440. In alternate embodiments, the first portion 435 may comprise an equivalent number of one or more slots 445 than the second portion 440. Each of the one or more slots 445 may be openings through the thickness of either the first portion 435 or the second portion 440. Each of the one or more slots 445 may be any suitable size, height, shape, and combinations thereof. The one or more slots 445 may be configured to allow for acoustic signals to travel from the interior of the drill collar 400 to the exterior of the drill collar 400 without interference from the structure of the drill collar 400, where the acoustic signals may be generated from the ring transmitter module 410 and/or the plurality of dual bender transmitters 415.

As illustrated, the acoustic logging device 126 may further comprise a sleeve 450 disposed between the first tubular 405 and the drill collar 400. The sleeve 450 may be configured to seal and protect the ring transmitter module 410 and the plurality of dual bender transmitters 415 from an external environment (for example, drilling muds, hydrocarbons, etc.). The sleeve 450 may comprise any suitable size, height, shape, and any combinations thereof. Further, the sleeve 450 may comprise any suitable materials, such as metals, nonmetals, polymers, composites, and any combinations thereof. In one or more embodiments, the sleeve 450 may provide an isolation to borehole mud away from the oil-filled transmitter section. (for example, the ring transmitter module 410 and the plurality of dual bender transmitters 415). Although not shown here, a typical bellow or piston type of compensator may be included to provide pressure compensation.

Figure 5:
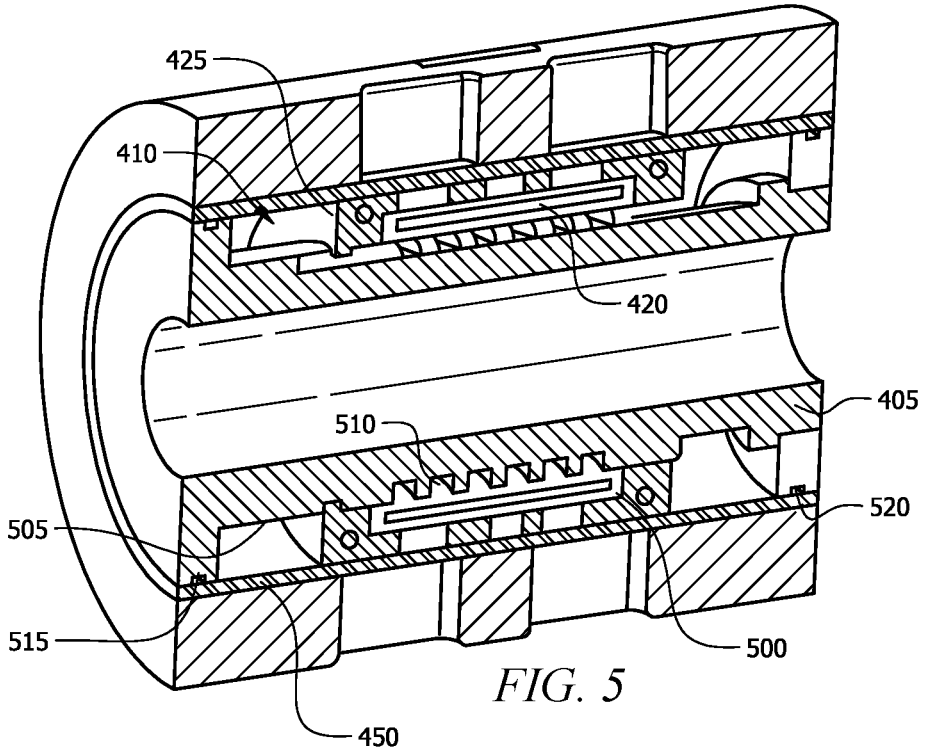
FIG. 5 is a diagram illustrating an example ring transmitter module of the acoustic logging device of FIG. 4, according to one or more aspects of the present disclosure.

FIG. 5 illustrates an isometric view of the ring transmitter module 410. As previously described, the ring transmitter module 410 comprises the PZT ring transmitter 420 and the cage 425. In one or more embodiments, the ring transmitter module 410 may further comprise a transmitter sleeve 500. The transmitter sleeve 500 may be configured to protect the structural integrity of the PZT ring transmitter 420 and to damp the strong length resonating mode of a cylinder (i.e., the PZT ring transmitter 420) to extend the frequency bandwidth outputted by the PZT ring transmitter 420. The transmitter sleeve 500 may comprise any suitable size, height, shape, and any combinations thereof. Further, the transmitter sleeve 500 may comprise any suitable dampening materials, such as nonmetals, polymers, composites, and any combinations thereof. In embodiments, the transmitter sleeve 500 may comprise rubber. As illustrated, the PZT ring transmitter 420 may be disposed within the transmitter sleeve 500, wherein the transmitter sleeve 500 may be disposed between the cage 425 and an exterior 505 of the first tubular member 405. There may be a plurality of grooves 510 disposed on the exterior 505 of the first tubular member 405. In one or more embodiments, the transmitter sleeve 500 may be disposed over and around the plurality of grooves 510 while within the cage 425. Without limitations, any suitable number of grooves may be used as the plurality of groove 510. Each of the plurality of grooves 510 may be disposed parallel to each other and may comprise equivalent dimensions. In alternate embodiments, the each of the plurality of grooves 510 may comprise different dimensions from each other. In one or more embodiments, the plurality of grooves 510 may contain a suitable fluid, such as oil. The plurality of grooves 510 may be completely filled or at least partially filled with the suitable fluid. The plurality of grooves 510 may be configured to provide for a greater acoustic compressibility inside the PZT ring transmitter 420 in order to generate an acoustic signal output with a larger magnitude. The breathing motion of an enclosed PZT ring transmitter 410 may depend upon the compressibility of fluid volume inside the structure, and the plurality of grooves 510 may increase the total fluid volume to make it more compressible and allows for a larger amplitude of vibration.

As illustrated, the ring transmitter module 410 may be sealed between the first tubular member 405 and the sleeve 450. There may be a first seal 515 disposed uphole from the ring transmitter module 410 and a second seal 520 disposed downhole from the ring transmitter module 410. Both the first seal 515 and the second seal 520 may be disposed away from the ring transmitter module 410 by a pre-determined distance. In embodiments, the pre-determined distance from the first seal 515 to the ring transmitter module 410 may be approximately equivalent to the pre-determined distance from the second seal 520 to the ring transmitter module 410. In alternate embodiments, the pre-determined distance from the first seal 515 to the ring transmitter module 410 may be different from the pre-determined distance from the second seal 520 to the ring transmitter module 410. Both the first seal 515 and the second seal 520 may be configured to form a seal against the interior of the sleeve 450 and the exterior of another internal component (for example, the first tubular member 405 or a component coupled to the first tubular member 405). In embodiments, any suitable sealing element may be used as the first seal 515 and the second seal 520.

Figure 6:
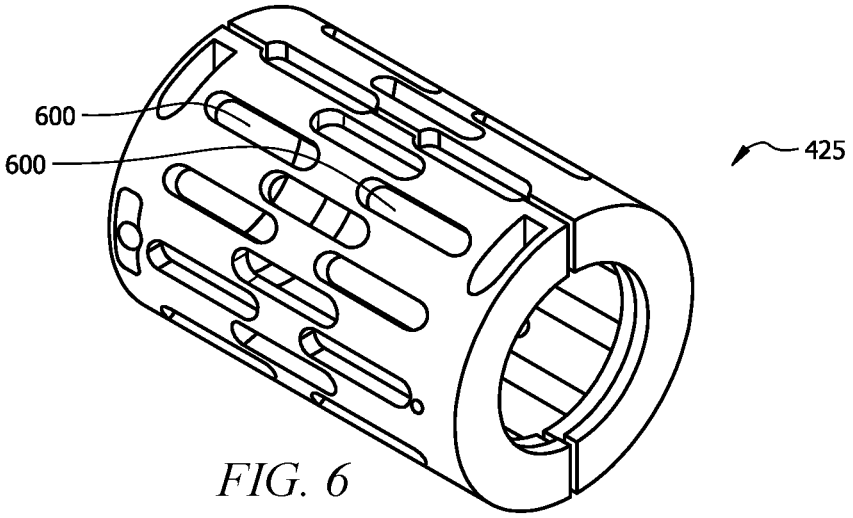
FIG. 6 is a diagram illustrating an example cage for the ring transmitter module of FIG. 5, according to one or more aspects of the present disclosure.

FIG. 6 illustrates an isometric view of the cage 425. The cage 425 may comprise one or more slots 600 disposed throughout the cage 425. The cage 425 may comprise any suitable number of one or more slots 600. In one or more embodiments, the one or more slots 600 of the cage 425 may be similar to the one or more slots 445 (referring to FIG. 4) of the first portion 435 (referring to FIG. 4) and the second portion 440 (referring to FIG. 4) of the drill collar 400 (referring to FIG. 4). In embodiments, the one or more slots 600 may at least partially align with the one or more slots 445 of the first portion 435. Each of the one or more slots 600 may be openings through the thickness of the cage 425. Each of the one or more slots 600 may be any suitable size, height, shape, and combinations thereof. The one or more slots 600 may be configured to allow for acoustic signals to travel from an interior of the cage 425, where the PZT ring transmitter 420 (referring to FIG. 4) is disposed, towards the drill collar 400 without interference from the structure of the cage 425, where the acoustic signals may be generated from the PZT ring transmitter 420. In embodiments, the cage 425 may be configured to protect the PZT ring transmitter 420 from an external environment while allowing for acoustic signals to propagate outwards.

Figure 7:
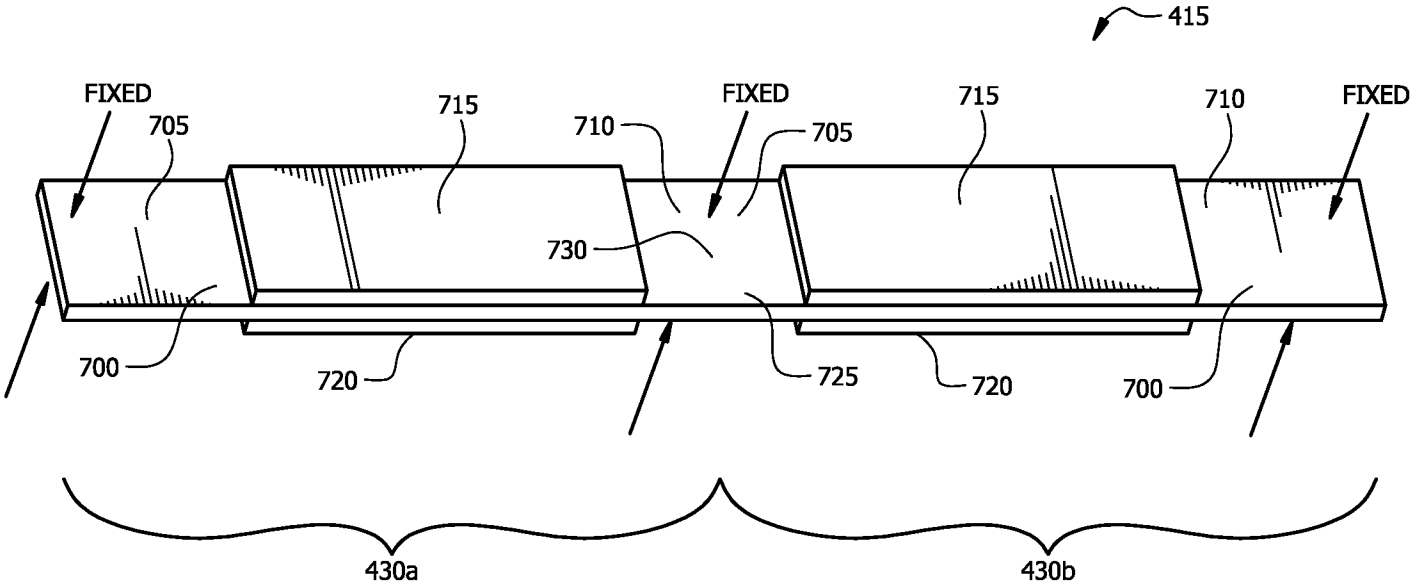
FIG. 7 is a diagram illustrating an example plurality of dual bender transmitters of the acoustic logging device of FIG. 4, according to one or more aspects of the present disclosure.

FIG. 7 illustrates an isometric view of one of the plurality of dual bender transmitters 415. In embodiments, each one of the plurality of dual bender transmitters 415 may comprise the first acoustic transducer 430*a* and the second acoustic transducer 430*b*. In some embodiments, the first and second acoustic transducers 430*a*, 430*b* may face the same direction, meaning that the first and second acoustic transducers 430*a*, 430*b* are configured to emit acoustic signals which propagate in the same direction. Each of the first and second acoustic transducers 430*a*, 430*b* may comprise a substrate 700. The substrate 700 may include a first end 705 and a second end 710. The first and second ends 705, 710 of the substrate 700 can also be referred to as the first and second ends 705, 710 of the acoustic transducers 430*a*, 430*b*. In the illustrated embodiment, the substrate 700 may have a flat and elongated rectangular geometry. In other embodiments, the substrate 700 may have any other geometric or non-geometric shapes. In one embodiment, the substrate 700 may be fabricated from brass. In other embodiments, the substrate 700 may be fabricated form various appropriate materials, such as steel, titanium, copper, among others.

Each of the acoustic transducers 430*a*, 430*b* may further include a first piezoelectric element 715 and a second piezoelectric element 720. The first piezoelectric element 715 may be coupled to one side of the substrate 700 and the second piezoelectric element 720 may be coupled to an opposite side of the substrate 700 such that the substrate 700 is disposed between the first and second piezoelectric elements 715, 720. In some embodiments, the first and second piezoelectric elements 715, 720 may have the same width as the substrate 700 and may be shorter than the substrate 700 such that the first and second ends 705, 710 of the substrate 700 extend beyond the first and second piezoelectric elements 715, 720. In some embodiments, the first and second piezoelectric elements 715, 720 may be aligned with each other.

The piezoelectric elements 715, 720 of the acoustic transducers 430*a*, 430*b* may share an electrical ground when coupled to the substrate 700. When the same AC voltage is applied to the piezoelectric elements 715, 720, the first piezoelectric element 715 may contract while the second piezoelectric element 720 may expand, or vice versa, due to piezoelectric stresses induced by the applied voltage. This may cause vibration or back and forth arcing of the acoustic transducers 430*a*, 430*b*, each of which generates an acoustic output.

As illustrated, the substrates 700 of the acoustic transducers 430*a*, 430*b* may be integral and continuous, in accordance with example embodiments of the present disclosure. Specifically, in certain such embodiments, the second end 710 of the substrate 700 of the first acoustic transducer 430*a* may be coupled to or integral with the first end 705 of the substrate 700 of the second acoustic transducer 430*b*. In other words, the substrates 700 of the first and second acoustic transducers 430*a*, 430*b* can be a singular, long substrate 725 that serves as the substrate 700 of the first and second acoustic transducers 430*a*, 430*b*. The portion of the long substrate 725 where the second end 710 of the first acoustic transducer 430*a* meets the first end 705 of the second acoustic transducer 430*b* can be called a mid-portion 730. In some embodiments, the first end 705 of the first acoustic transducer 430*a* and the second end 710 of the second acoustic transducer 430*b* may be fixed to an external structure and the mid-portion 730 is also fixed to the external structure. Thus, resonance of the first acoustic transducer 430*a* may be isolated from the second acoustic transducer 430*b* and vice versa. As such, the first and second acoustic transducers 430*a*, 430*b* may resonate and generate acoustic output independently.

In one or more embodiments, the first and second acoustic transducers 430*a*, 430*b* may be identical. In such embodiments, the first and second acoustic transducers 430*a*, 430*b* may have the same resonance frequencies. Thus, the total acoustic pressure output from a singular one of the plurality of dual bender transmitters 415 is the sum of the acoustic pressure output of each of the first and second acoustic transducers 430*a*, 430*b*.

In one or more embodiments, the first and second acoustic transducers 430*a*, 430*b* may have slightly different size parameters, such as different substrate lengths, widths, or thicknesses. Such variations may create an offset between the resonance frequencies of the first and second acoustic transducers 430*a*, 430*b*. In such embodiments, when excited with the same voltage, the acoustic output frequencies of the first and second acoustic transducers 430*a*, 430*b* are offset. Thus, the combination of the respective acoustic outputs is spread across a small frequency range and the total acoustic pressure output is relatively smoother around the resonant frequencies due to the superposition effect.

In one or more embodiments, the substrate lengths, widths, or thicknesses may vary up to 40%. In some embodiments, the first and second acoustic transducers 430*a*, 430*b* may be configured to generate acoustic outputs between 1-1.5 kHz at approximately 200 Pa/kV combined. In some embodiments, the first and second acoustic transducers 430*a*, 430*b* may be configured to generate combined acoustic outputs between 1-4 kHz. In some embodiments, the frequency of the first acoustic output generated by the first acoustic transducer 430*a* and the second acoustic transducer 430*b* may differ up to 2 kHz. In other embodiments, the first and second acoustic transducers 430*a*, 430*b* may be configured to generate acoustic outputs of lower or higher frequencies and/or with various amounts of offset.

In some embodiments, each one of the plurality of dual bender transmitters 415 may include more than two acoustic transducers (for example, acoustic transducers 430*a*, 430*b*), each of which is fixed to an external structure at its ends. In some embodiments, all the acoustic transducers within each one of the plurality of dual bender transmitters 415 may be formed on the same substrate, such as illustrated in FIG. 7, in which the substrate is exposed (e.g., not covered by piezoelectric material) between each acoustic transducer and fixed to the external structure. Each independently resonating portion may be considered as a distinct acoustic transducer.

Figure 8:
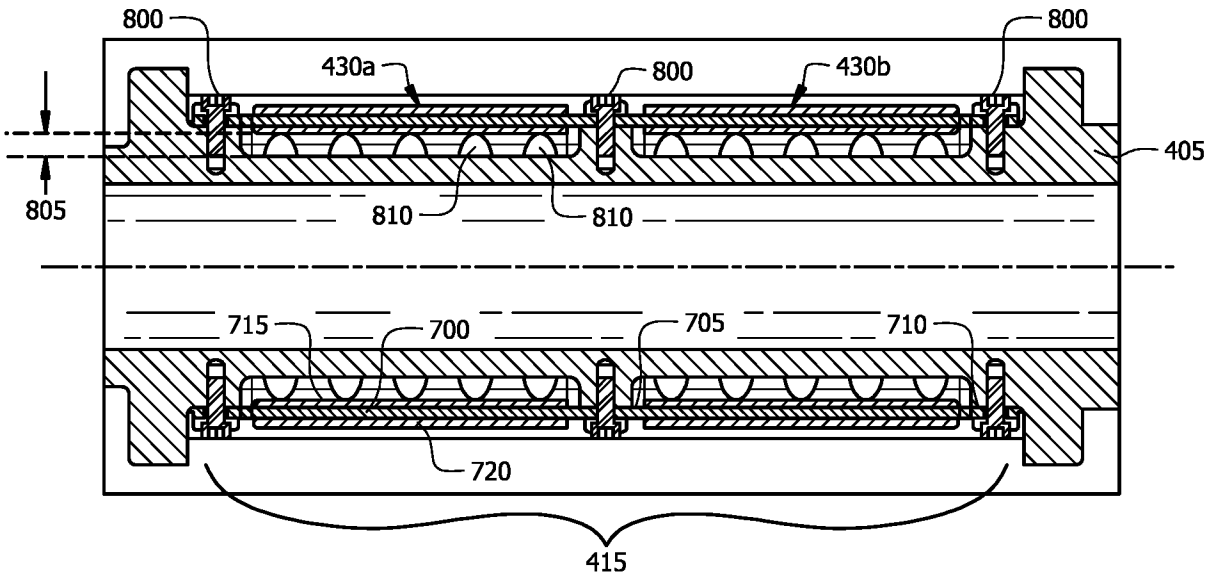
FIG. 8 is a diagram illustrating the example plurality of dual bender transmitters of the acoustic logging device of FIG. 4, according to one or more aspects of the present disclosure.

FIG. 8 illustrates a cross-sectional view of the plurality of dual bender transmitters 415. In one or more embodiments, the plurality of dual bender transmitters 415 may be coupled to the first tubular member 405. Each of the first and second acoustic transducers 430*a*, 430*b* of each one of the plurality of dual bender transmitters 415 may be fixed to the first tubular member 405 by the first and second ends 705, 710 of the substrates 700. The piezoelectric elements 715, 720 may not be fixed to the support structure and may be free to resonate. In some embodiments, the first and second ends 705, 710 of the substrates 700 may be fixed to the first tubular member 405 via fasteners 800. In embodiments, fasteners 800 may be pins, clamps, or the like. Thus, the acoustic transducers 430*a*, 430*b* may be free to resonate between the fixed ends 705, 710.

In some embodiments, the first and second acoustic transducers 430*a*, 430*b* may be disposed next to one another longitudinally, such that when orientated as such, the distance from the first end 705 of the first acoustic transducer 430*a* to the second end 710 of the second acoustic transducer 430*b* is at least as great as the combined length of the first acoustic transducer 430*a* and the second acoustic transducer 430*b*. In other embodiments, the first and second acoustic transducers 430*a*, 430*b* may be disposed next to each other laterally. In some embodiments, the first and second acoustic transducers 430*a*, 430*b* may be parallel and on the same plane. In some embodiments, the first and second acoustic transducers 430*a*, 430*b* may face the same direction. While two of the plurality of dual bender transmitters 415 are presently illustrated in FIG. 8, acoustic logging device 126 (referring to FIG. 1) is not limited to comprising two dual bender transmitters 415. Any suitable number of dual bender transmitters 415 may be utilized with the acoustic logging device 126. In one or more embodiments, there may be four dual bender transmitters 415 disposed at the same position along the length of the first tubular member and offset radially from each other by 90°.

As illustrated, there may be a gap 805 disposed between each of the first and second acoustic transducers 430*a*, 430*b* of each of the plurality of dual bender transmitters 415 and the first tubular member 405. Each gap 805 may be any suitable size, height, shape, and combinations thereof. In embodiments, the cross-section of the gap 805 may be the same as that of the respective first acoustic transducer 430*a* or second acoustic transducer 430*b* (for example, the gap 805 may have the same length and width dimensions). Without limitations, the depth of the gap 805 may be any suitable value in a range of from about 0.05 inches (0.127 cm) to about 0.5 inches (1.27 cm). There may also be an array of holes 810 disposed within the gaps 805 between each of the first and second acoustic transducers 430*a*, 430*b* and the first tubular member 405. The array of holes 810 may comprise of individual holes disposed in parallel along the length of the first tubular member 405. Each one of the array of holes 810 may be in the shape of a circle with a curvilinear cross-sectional shape that is connected through each of the gaps 805. As such, the array of holes 810 may provide for fluid communication throughout each of the gaps 805. In embodiments, any suitable number of holes may be implemented as the array of holes 810. Each of the gaps 805 and the array of holes 810 may contain a suitable fluid, such as oil. The gaps 805 and the array of holes 810 may be completely filled or at least partially filled with the suitable fluid. Both of the gaps 805 and the array of holes 810, at least partially filled with the suitable fluid, may be configured to provide for a greater acoustic output for the plurality of dual bender transmitters 415 when operating in a monopole, dipole, or quadrupole mode. The array of holes 810 may share oil volume of between the different sets of the plurality of dual bender transmitters 415, wherein the shared volume not only increase the compressibility to allow larger amplitude of a vibration but also may provide a better acoustic coupling among different transmitter pairs (for example, the first and second acoustic transducers 430*a*, 430*b*) to make them move together in sync or out of sync. For example, to excite a quadruple motion, two pairs of the plurality of dual bender transmitters 415 may be actuated to have each pair moving in opposite phase. In embodiments, one pair may bend inward and the other pair may bend outward, and the net oil volume change inside may remain at zero. Therefore, each of the gaps 805 and the array of holes 810 may facilitate the quadruple vibration.

With reference to FIGS. 2-8, the acoustic logging device 126 may be implemented in a through tubing cement evaluation wireline operation, wherein the frequency bandwidth requirement is large in order to generate sharp impulse with better time resolution. The cementing process may generally involve mixing a slurry of cement, cement additives, and water, then pumping the mix down through a casing into an annulus formed between the casing and the wall of the wellbore 104. Cementing can add proper support for the casing and serves as a hydraulic seal. This hydraulic seal may be particularly important in achieving zonal isolation and preventing fluid migration from various zones into groundwater resources.

One physical characteristic that is used to represent the integrity of the cement is the bond index (BI). BI is a qualitative measurement of cement adhesion to the exterior casing wall, where a BI value of 1.0 represents a perfect cement bond whereas a BI value of 0 represents no adhesion. Traditional cement evaluation techniques may use a wireline logging tool to obtain the BI in the wellbore 104.

Cement Bonding Logging (CBL) is a procedure in the assessment of a well that ensures integrity, reduces wellbore collapse risks, and verifies zonal isolation. Although various types of logging may be performed for cement bonding analysis, sonic/acoustic logging performed in a wireline operation is typically used. Sonic logging may generate acoustic waves that travel from a transmitter (for example, PZT ring transmitter 420 or the plurality of dual bender transmitters 415) to the wellbore 104 and that return back to one or more receivers to obtain information in the form of acoustic wave data. Various properties of the returning waves, such as interval transit time, amplitude, and phase, may be assessed to obtain information about the wellbore, including the BI.

During cementing, the wellbore 104 may be empty or filled with a fluid medium, such as drilling mud or uncured cement. A casing may be attached to the walls of the wellbore 104 via cement pumped down from the surface. In some regions of the wellbore 104, the cement may not be fully adhered to the casing. In other regions, the casing may be completely free of cement depending on the location and time that the cement has had to travel up the annulus between the casing and the wellbore 104.

The interaction between acoustic waves and the cement around the casing may be used to determine the cement BI. The provided systems and methods may include at least one logging tool (for example, acoustic logging device 126) that may be configured as a CBL tool, may be incorporated into a CBL tool, and combinations thereof. For example, the acoustic logging device 126 may be coupled to the conveyance 112 and deployed into the wellbore 104.

As previously described, acoustic logging device 126 may include the PZT ring transmitter 420 and the plurality of dual bender transmitters 415 that are configured to transmit acoustic signals within the wellbore 104. The transmitted signals may travel along the casing as casing waves and consequently induce corresponding acoustic echo responses. The presence of cement behind the casing may be detected as a rapid decay of casing resonance whereas a lack of cement may be detected as a long resonant decay. Acoustic receivers in the acoustic logging device 126, or at another suitable location along the wireline, may receive the acoustic echo responses that carry the cement bonding information. The received acoustic echo responses may then be transmitted uphole for further processing to determine the BI of the cement and other suitable parameters.

Technical advantages of this disclosure may include one or more of the following. The benefit of having the transmitter sleeve 500 may be to provide for a wider bandwidth for the PZT ring transmitter 420 by dampening the cylinder length mode resonance as well as boost beyond resonance sensitivity. Traditional wireline transmitters may have fluid underneath the PZT ring transmitter 420, and fluid generally does not provide effective dampening of length resonating mode of a PZT ring transmitter 420. Therefore, for measurement applications that require good pulse time resolution, the fluid-damp transmitter would be unable to provide high quality measurements. Further, the transmitter sleeve 500 may provide structural support for the PZT ring transmitter to survive vibrations experienced in the downhole environment. In particular, the through tubing cement evaluation operation may require a wide or large bandwidth for transmission in order to deal with a variety of casing sizes and thicknesses for acoustic transmissions and casing reflections. Additionally, by including both the PZT ring transmitter 420 and the plurality of dual bender transmitters 415, an operator may be capable of choosing between operating in any of a monopole, dipole, or quadrupole modes.

An embodiment of the present disclosure is an acoustic logging device, comprising: a first tubular member comprising a plurality of grooves disposed on an exterior of the first tubular member, wherein the plurality of grooves are at least partially filled with a fluid; a ring transmitter module disposed around an exterior of the first tubular member, comprising: a piezoelectric (PZT) ring transmitter; a transmitter sleeve, wherein the PZT ring transmitter is disposed within the transmitter sleeve; and a cage, wherein the transmitter sleeve is disposed between the cage and the exterior of the first tubular member, wherein the transmitter sleeve is disposed over the plurality of grooves; and a plurality of dual bender transmitters, wherein each one of the plurality of dual bender transmitters comprises a first acoustic transducer and a second acoustic transducer, wherein the plurality of dual bender transmitter are coupled to the first tubular member through fasteners and disposed uphole from the ring transmitter module, wherein there is a gap disposed beneath each one of the plurality of dual bender transmitters in the exterior of the first tubular member, wherein there is an array of holes connecting each of the gaps together and providing fluid communication between the gaps, wherein the gaps and the array of holes are at least partially filled with a fluid.

In one or more embodiments described in the preceding paragraph, the depth of each one of the gaps is in a range of from about 0.05 inches to about 0.5 inches. In one or more embodiments described above, wherein the first tubular member is disposed within a drill collar, wherein the drill collar comprises a first portion and a second portion. In one or more embodiments described above, wherein the ring transmitter module aligns within the length of the first portion of the drill collar, wherein the plurality of dual bender transmitters aligns within the length of the second portion of the drill collar, wherein both the first portion and the second portion comprise one or more slots that are configured to allow for acoustic signals to travel from the interior of the drill collar to the exterior of the drill collar without interference from the structure of the drill collar. In one or more embodiments described above, further comprising a sleeve disposed around the first tubular member, wherein the ring transmitter module and the plurality of dual bender transmitters are disposed within the sleeve, wherein the sleeve is configured to provide pressure balance and isolation from an external environment. In one or more embodiments described above, wherein the cage comprises one or more slots disposed throughout the cage configured to allow for acoustic signals to travel from the PZT ring transmitter outwards without interference from the structure of the cage. In one or more embodiments described above, wherein the plurality of dual bender transmitters are configured to produce a monopole signal, a dipole signal, a quadrupole signal, or combinations thereof.

Another embodiment of the present disclosure is a method of operating an acoustic logging device, comprising: disposing the acoustic logging device downhole into a wellbore via a conveyance, wherein the acoustic logging device comprises: a first tubular member comprising a plurality of grooves disposed on an exterior of the first tubular member, wherein the plurality of grooves are at least partially filled with a fluid; a ring transmitter module disposed around an exterior of the first tubular member, comprising: a piezoelectric (PZT) ring transmitter; a transmitter sleeve, wherein the PZT ring transmitter is disposed within the transmitter sleeve; and a cage, wherein the transmitter sleeve is disposed between the cage and the exterior of the first tubular member, wherein the transmitter sleeve is disposed over the plurality of grooves; and a plurality of dual bender transmitters, wherein each one of the plurality of dual bender transmitters comprises a first acoustic transducer and a second acoustic transducer, wherein the plurality of dual bender transmitter are coupled to the first tubular member through fasteners and disposed uphole from the ring transmitter module, wherein there is a gap disposed beneath each one of the plurality of dual bender transmitters in the exterior of the first tubular member, wherein there is an array of holes connecting each of the gaps together and providing fluid communication between the gaps, wherein the gaps and the array of holes are at least partially filled with a fluid; actuating the ring transmitter module to produce an acoustic signal; actuating at least a portion of the plurality of dual bender transmitters to produce an acoustic signal; and receiving signals related to a parameter of a subterranean formation, wherein the received signals are based, at least in part, on the produced acoustic signals from the ring transmitter module, the plurality of dual bender transmitters, or combinations thereof.

In one or more embodiments described in the preceding paragraph, further comprising transmitting the received signals to an information handling system for processing to determine the parameter of the subterranean formation. In one or more embodiments described above, further comprising displaying the parameter of the subterranean formation after processing the received signals with the information handling system. In one or more embodiments described above, wherein actuating at least a portion of the plurality of dual bender transmitters comprises of actuating the amount of the plurality of dual bender transmitters to produce a monopole signal. In one or more embodiments described above, wherein actuating at least a portion of the plurality of dual bender transmitters comprises of actuating the amount of the plurality of dual bender transmitters to produce a dipole signal. In one or more embodiments described above, wherein actuating at least a portion of the plurality of dual bender transmitters comprises of actuating the amount of the plurality of dual bender transmitters to produce a quadrupole signal. In one or more embodiments described above, wherein the conveyance is a wireline, wherein the acoustic logging device is configured to be used in a through tubing cement evaluation wireline operation to evaluate the integrity of cement disposed within the wellbore. In one or more embodiments described above, wherein the conveyance is a drill collar, wherein the first tubular member is disposed within the drill collar, wherein the drill collar comprises a first portion and a second portion, wherein the ring transmitter module aligns within the length of the first portion of the drill collar, wherein the plurality of dual bender transmitters aligns within the length of the second portion of the drill collar, wherein both the first portion and the second portion comprise one or more slots that are configured to allow for acoustic signals to travel from the interior of the drill collar to the exterior of the drill collar without interference from the structure of the drill collar.

A further embodiment of the present disclosure is a drilling system, comprising: a wellbore; a bottom-hole assembly disposed near a distal end of a conveyance, wherein the bottom-hole assembly comprises an acoustic logging device, wherein the acoustic logging device comprises: a first tubular member comprising a plurality of grooves disposed on an exterior of the first tubular member, wherein the plurality of grooves are at least partially filled with a fluid; a ring transmitter module disposed around an exterior of the first tubular member, comprising: a piezoelectric (PZT) ring transmitter; a transmitter sleeve, wherein the PZT ring transmitter is disposed within the transmitter sleeve; and a cage, wherein the transmitter sleeve is disposed between the cage and the exterior of the first tubular member, wherein the transmitter sleeve is disposed over the plurality of grooves; and a plurality of dual bender transmitters, wherein each one of the plurality of dual bender transmitters comprises a first acoustic transducer and a second acoustic transducer, wherein the plurality of dual bender transmitter are coupled to the first tubular member through fasteners and disposed uphole from the ring transmitter module, wherein there is a gap disposed beneath each one of the plurality of dual bender transmitters in the exterior of the first tubular member, wherein there is an array of holes connecting each of the gaps together and providing fluid communication between the gaps, wherein the gaps and the array of holes are at least partially filled with a fluid; and an information handling system communicatively coupled to the acoustic logging device.

In one or more embodiments described in the preceding paragraph, wherein the bottom-hole assembly further comprises a telemetry module, wherein the telemetry module is communicatively coupled to both the acoustic logging device and to the information handling system. In one or more embodiments described above, wherein the conveyance is a drill collar, wherein the first tubular member is disposed within the drill collar, wherein the drill collar comprises a first portion and a second portion, wherein both the first portion and the second portion comprise one or more slots that are configured to allow for acoustic signals to travel from the interior of the drill collar to the exterior of the drill collar without interference from the structure of the drill collar. In one or more embodiments described above, wherein the ring transmitter module aligns within the length of the first portion of the drill collar, wherein the plurality of dual bender transmitters aligns within the length of the second portion of the drill collar. In one or more embodiments described above, further comprising a sleeve disposed around the first tubular member, wherein the ring transmitter module and the plurality of dual bender transmitters are disposed within the sleeve, wherein the sleeve is configured to provide pressure balance and isolation from an external environment.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. An acoustic logging device, comprising:

a first tubular member comprising a plurality of grooves disposed on an exterior of the first tubular member, wherein the plurality of grooves are at least partially filled with a fluid;

a ring transmitter module disposed around the exterior of the first tubular member, comprising:

a piezoelectric (PZT) ring transmitter;

a transmitter sleeve, wherein the PZT ring transmitter is disposed within the transmitter sleeve; and a cage, wherein the transmitter sleeve is disposed between the cage and the exterior of the first tubular member, wherein the transmitter sleeve is disposed over the plurality of grooves, and wherein the cage comprises one or more slots disposed throughout the cage and configured to allow for acoustic signals to travel from the PZT ring transmitter outwards from a structure of the cage; and a plurality of dual bender transmitters, wherein each one of the plurality of dual bender transmitters comprises a first acoustic transducer and a second acoustic transducer, wherein the plurality of dual bender transmitter are coupled to the first tubular member through fasteners and disposed uphole from the ring transmitter module, wherein there is a gap disposed beneath each one of the plurality of dual bender transmitters in the exterior of the first tubular member, wherein there is an array of holes connecting each of the gaps together and providing fluid communication between the gaps, wherein the gaps and the array of holes are at least partially filled with a fluid.

2. The acoustic logging device of claim 1, wherein a depth of each one of the gaps is in a range of from about 0.05 inches to about 0.5 inches.

3. The acoustic logging device of claim 1, wherein the first tubular member is disposed within a drill collar, wherein the drill collar comprises a first portion and a second portion.

4. The acoustic logging device of claim 3, wherein the ring transmitter module aligns within a length of the first portion of the drill collar, wherein the plurality of dual bender transmitters aligns within a length of the second portion of the drill collar, wherein both the first portion and the second portion comprise one or more slots that are configured to allow for the acoustic signals to travel from an interior of the drill collar to the exterior of the drill collar without interference from a structure of the drill collar.

5. The acoustic logging device of claim 1, further comprising a sleeve disposed around the first tubular member, wherein the ring transmitter module and the plurality of dual bender transmitters are disposed within the sleeve, wherein the sleeve is configured to provide pressure balance and isolation from an external environment.

6. The acoustic logging device of claim 1, wherein the plurality of dual bender transmitters are configured to produce a monopole signal, a dipole signal, a quadrupole signal, or combinations thereof.

7. A method of operating an acoustic logging device, comprising:

disposing the acoustic logging device downhole into a wellbore via a conveyance, wherein the acoustic logging device comprises:

a first tubular member comprising a plurality of grooves disposed on an exterior of the first tubular member, wherein the plurality of grooves are at least partially filled with a fluid;

a ring transmitter module disposed around the exterior of the first tubular member, comprising:

a piezoelectric (PZT) ring transmitter;

a transmitter sleeve, wherein the PZT ring transmitter is disposed within the transmitter sleeve; and a cage, wherein the transmitter sleeve is disposed between the cage and the exterior of the first tubular member, wherein the transmitter sleeve is disposed over the plurality of grooves, and wherein the cage comprises one or more slots disposed throughout the cage and configured to allow for acoustic signals to travel from the PZT ring transmitter outwards from structure of the cage; and a plurality of dual bender transmitters, wherein each one of the plurality of dual bender transmitters comprises a first acoustic transducer and a second acoustic transducer, wherein the plurality of dual bender transmitter are coupled to the first tubular member through fasteners and disposed uphole from the ring transmitter module, wherein there is a gap disposed beneath each one of the plurality of dual bender transmitters in the exterior of the first tubular member, wherein there is an array of holes connecting each of the gaps together and providing fluid communication between the gaps, wherein the gaps and the array of holes are at least partially filled with a fluid;

actuating the ring transmitter module to produce an acoustic signal;

actuating at least a portion of the plurality of dual bender transmitters to produce an acoustic signal; and receiving signals related to a parameter of a subterranean formation, wherein the received signals are based, at least in part, on the produced acoustic signals from the ring transmitter module, the plurality of dual bender transmitters, or combinations thereof.

8. The method of claim 7, wherein the conveyance is a drill collar, wherein the first tubular member is disposed within the drill collar, wherein the drill collar comprises a first portion and a second portion, wherein the ring transmitter module aligns within a length of the first portion of the drill collar, wherein the plurality of dual bender transmitters aligns within a length of the second portion of the drill collar, wherein both the first portion and the second portion comprise one or more slots that are configured to allow for the acoustic signals to travel from an interior of the drill collar to the exterior of the drill collar without interference from a structure of the drill collar.

9. The method of claim 7, further comprising transmitting the received signals to an information handling system for processing to determine the parameter of the subterranean formation.

10. The method of claim 9, further comprising displaying the parameter of the subterranean formation after processing the received signals with the information handling system.

11. The method of claim 7, wherein actuating at least the portion of the plurality of dual bender transmitters comprises of actuating an amount of the plurality of dual bender transmitters to produce a monopole signal.

12. The method of claim 7, wherein actuating at least the portion of the plurality of dual bender transmitters comprises of actuating an amount of the plurality of dual bender transmitters to produce a dipole signal.

13. The method of claim 7, wherein actuating at least the portion of the plurality of dual bender transmitters comprises of actuating an amount of the plurality of dual bender transmitters to produce a quadrupole signal.

14. The method of claim 7, wherein the conveyance is a wireline, wherein the acoustic logging device is configured to be used in a through tubing cement evaluation wireline operation to evaluate an integrity of cement disposed within the wellbore.

15. A drilling system, comprising:

a wellbore;

a bottom-hole assembly disposed near a distal end of a conveyance, wherein the bottom-hole assembly comprises an acoustic logging device, wherein the acoustic logging device comprises:

a first tubular member comprising a plurality of grooves disposed on an exterior of the first tubular member, wherein the plurality of grooves are at least partially filled with a fluid;

a ring transmitter module disposed around the exterior of the first tubular member, comprising:

a piezoelectric (PZT) ring transmitter;

a transmitter sleeve, wherein the PZT ring transmitter is disposed within the transmitter sleeve; and a cage, wherein the transmitter sleeve is disposed between the cage and the exterior of the first tubular member, wherein the transmitter sleeve is disposed over the plurality of grooves, and wherein the cage comprises one or more slots disposed throughout the cage and configured to allow for acoustic signals to travel from the PZT ring transmitter outwards from a structure of the cage; and a plurality of dual bender transmitters, wherein each one of the plurality of dual bender transmitters comprises a first acoustic transducer and a second acoustic transducer, wherein the plurality of dual bender transmitter are coupled to the first tubular member through fasteners and disposed uphole from the ring transmitter module, wherein there is a gap disposed beneath each one of the plurality of dual bender transmitters in the exterior of the first tubular member, wherein there is an array of holes connecting each of the gaps together and providing fluid communication between the gaps, wherein the gaps and the array of holes are at least partially filled with a fluid; and an information handling system communicatively coupled to the acoustic logging device.

16. The drilling system of claim 15, further comprising a sleeve disposed around the first tubular member, wherein the ring transmitter module and the plurality of dual bender transmitters are disposed within the sleeve, wherein the sleeve is configured to provide pressure balance and isolation from an external environment.

17. The drilling system of claim 15, wherein the bottom-hole assembly further comprises a telemetry module, wherein the telemetry module is communicatively coupled to both the acoustic logging device and to the information handling system.

18. The drilling system of claim 15, wherein the conveyance is a drill collar, wherein the first tubular member is disposed within the drill collar, wherein the drill collar comprises a first portion and a second portion, wherein both the first portion and the second portion comprise one or more slots that are configured to allow for the acoustic signals to travel from an interior of the drill collar to the exterior of the drill collar without interference from a structure of the drill collar.

19. The drilling system of claim 18, wherein the ring transmitter module aligns within a length of the first portion of the drill collar, wherein the plurality of dual bender transmitters aligns within a length of the second portion of the drill collar.

* * * * *